US009026345B2

(12) United States Patent
Dudar et al.

(10) Patent No.: US 9,026,345 B2
(45) Date of Patent: May 5, 2015

(54) METHOD AND SYSTEM FOR FUEL VAPOR CONTROL

(75) Inventors: Aed M. Dudar, Canton, MI (US); Robert Roy Jentz, Westland, MI (US); Scott A. Bohr, Plymouth, MI (US); Niels Christopher Kragh, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 338 days.

(21) Appl. No.: 13/612,359

(22) Filed: Sep. 12, 2012

(65) Prior Publication Data

US 2014/0074385 A1 Mar. 13, 2014

(51) Int. Cl.
*F02M 25/08* (2006.01)

(52) U.S. Cl.
CPC ..... *F02M 25/0818* (2013.01)

(58) Field of Classification Search
CPC . F02D 19/025; F02D 19/027; F02D 19/0623; F02D 19/0628; F02D 41/22; F02D 2041/225; F02M 25/0818
USPC ..... 701/107, 112, 113; 123/457, 461, 510, 123/511, 516, 518, 520, 198 D; 73/114.38, 73/114.39
See application file for complete search history.

(56) References Cited

U.S. PATENT DOCUMENTS

| | | | | |
|---|---|---|---|---|
| 5,526,675 | A | 6/1996 | Ratton | |
| 7,043,375 | B2 | 5/2006 | Streib | |
| 8,019,525 | B2 * | 9/2011 | Debastos et al. | 701/102 |
| 8,056,540 | B2 * | 11/2011 | Debastos et al. | 123/521 |
| 8,074,627 | B2 | 12/2011 | Siddiqui | |
| 8,200,411 | B2 * | 6/2012 | Debastos et al. | 701/102 |
| 2010/0108038 | A1 | 5/2010 | Kang | |
| 2014/0107906 | A1 * | 4/2014 | Jentz et al. | 701/102 |
| 2014/0297071 | A1 * | 10/2014 | Dudar et al. | 701/22 |
| 2014/0316638 | A1 * | 10/2014 | Dudar et al. | 701/29.4 |

FOREIGN PATENT DOCUMENTS

EP 1801394 A1 12/2005

OTHER PUBLICATIONS

Jentz, Robert Roy et al., "Engine-Off Refueling Detection Method," U.S. Appl. No. 13/788,624, filed Mar. 7, 2013, 32 pages.

* cited by examiner

*Primary Examiner* — Hai Huynh
(74) *Attorney, Agent, or Firm* — Julia Voutyras; Alleman Hall McCoy Russell & Tuttle LLP

(57) ABSTRACT

Methods and systems are provided for performing a vehicle-off fuel system leak test. A vehicle controller may be woken up after a vehicle has been in a key-off condition for a sufficient amount of time to monitor a fuel tank for pressure and temperature stabilization. If the pressure and temperature of the fuel tank is stable, a fuel pump may be operated to raise a fuel tank vapor pressure, and fuel system leaks are identified based on a rate of pressure decay from the fuel tank.

20 Claims, 6 Drawing Sheets

METHOD AND SYSTEM FOR FUEL VAPOR CONTROL

FIELD

The present application relates to fuel system leak detection in vehicles, such as hybrid vehicles.

BACKGROUND AND SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of leaks that could release fuel vapors to the atmosphere.

Evaporative leaks may be identified using engine-off natural vacuum (EONV) during key-off conditions when a vehicle engine is not operating. Therein, correlations between temperature and vacuum build-up are advantageously used to detect fuel system leaks. In particular, a fuel system is isolated at key-off, and as a fuel tank cools down, a vacuum is generated therein. Vacuum generation is monitored over a long time, and based on a rate of subsequent vacuum bleed-up, a leak can be identified. Another approach for leak detection during key-off conditions is shown by Siddiqui in U.S. Pat. No. 8,074,627. Therein, a fuel pump is operated to store vacuum in an accumulator. The stored vacuum is then applied on the fuel system during a key-off condition to identify a leak.

The inventors herein have identified a potential issue with such approaches. In these approaches, temperature (of the fuel tank) is not only a control factor but also a noise factor. For example, the EONV approaches rely on a correlation between fuel tank temperature and pressure to generate and apply vacuum on the fuel tank. However, depending on how long a vehicle engine was on before the leak test was initiated (which affects how much heat was rejected from the running engine to the fuel tank), a temperature of the parking surface where the vehicle is parked, as well as wind and sun loading on the fuel system, leak test results may vary. The same factors may likewise corrupt pressure data collected in the approach of Siddiqui. Consequently, in either approach, false failures or false passes may occur, degrading exhaust emissions. The problem may be exacerbated in hybrid vehicles where engine run times are low such that heat rejection to the fuel tank during engine operation is also low. Consequently, a temperature drop in the fuel tank during the key-off may not be enough to generate sufficient EONV for a leak test.

In one example, the above issue may be at least partly addressed by a method for a vehicle fuel system, comprising: during a vehicle-off condition, and while a fuel tank temperature stays within a threshold range, operating a fuel pump to raise a fuel tank vapor pressure to identify leaks in the fuel system. In this way, fuel system leaks can be performed with reduced noise contribution from fuel tank temperatures.

For example, a vehicle powertrain control module (PCM) may be set to a sleep mode in response to a vehicle-off event (e.g., a key-off event). The PCM may then we woken up after a first duration (e.g., in hours) has elapsed since the key-off event. As such, the first duration may be sufficiently long such that fuel tank temperatures and pressures are expected to have stabilized by the time the PCM is woken up. The PCM may seal the fuel system upon waking up and monitor changes in fuel tank temperature and/or pressure for a second duration that is shorter than the first duration (e.g., in seconds). If there is no substantial change in fuel tank temperature over the second duration (e.g., the fuel tank temperature remains within a range), it may be assumed that if a leak test is performed, a temperature contribution to noise during the diagnostics may be substantially low (or negligible). Accordingly, a fuel pump coupled to the fuel tank may be operated to initiate a leak test. By operating the fuel pump, fuel in the fuel tank is agitated, causing a fuel vapor pressure to increase. That is, a number of moles of fuel in the vapor space of the fuel tank is increased, thereby increasing a fuel tank pressure. Following the fuel tank pressure build-up, pump operation is discontinued, and a rate of pressure decay or bleed-down is monitored and compared to a threshold rate. The threshold rate may be calibrated for the fuel tank temperature. Additionally, the threshold rate may be calibrated to compensate for fuel level, altitude, and fuel type. The presence of a leak may be indicated based on bleeding down of the fuel tank pressure at a faster rate (e.g., faster than the threshold rate).

In this way, the principles of an ideal gas law may be advantageously used to perform an engine-off leak test without relying on temperature as a control factor. By operating a fuel pump during vehicle off conditions when fuel tank temperatures are stable, a number of moles of fuel vapor in a fuel tank can be increased and a relation between the moles of fuel vapor and a fuel tank pressure can be advantageously used to identify fuel system leaks. By reducing the reliance on temperature as a control factor in the fuel system leak test, temperature-induced noise factors in a leak test can also be reduced. In addition, an engine-off leak test can be reliably and accurately performed even in vehicles, such as hybrid vehicles, where there is reduced heat rejection to a fuel tank due to infrequent engine operation. By performing an active leak test that is based on the molar fuel content of fuel vapor rather than an opportunistic leak test that is based on the temperature of fuel vapor, the frequency of running and completing a leak test is improved. By improving leak detection, the quality of exhaust emissions and likelihood of emissions compliance is improved.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF THE DRAWINGS

The subject matter of the present disclosure will be better understood from reading the following detailed description of non-limiting embodiments, with reference to the attached drawings, wherein.

DETAILED DESCRIPTION

Figure 1:
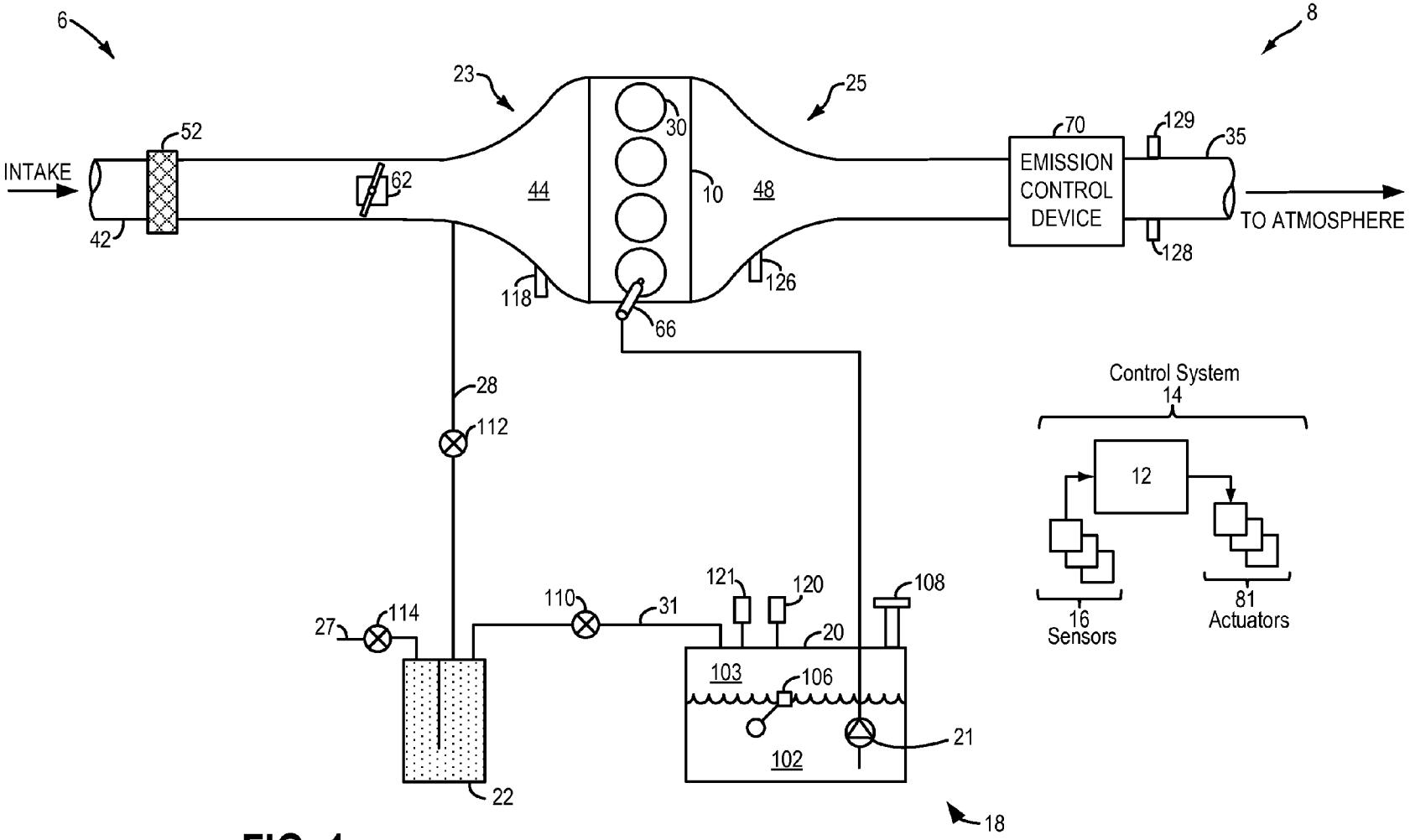
FIG. 1 shows a schematic depiction of a fuel system coupled to an engine system in a hybrid vehicle.

Methods and systems are provided for identifying leaks in a fuel system coupled to an engine in a hybrid vehicle, such as the fuel system of FIG. 1. A leak test may be performed during selected vehicle-off conditions when fuel tank temperatures and pressures are stable. A controller may be configured to perform a control routine, such as the example routine of FIG. 2, to confirm stabilization of fuel tank temperatures and pressures after a sufficient duration has elapsed since a vehicle-off event. The controller may then perform a control routine, such as the routine of FIG. 3 to operate a fuel pump to actively increase a molar content of fuel in the fuel tank's vapor space, and thereby raise a fuel vapor pressure. A fuel system leak may be subsequently identified based on a rate of pressure decay from the fuel tank. Example leak tests are described at FIGS. 4-6. In this way, fuel system leaks may be identified based on a correlation between fuel in a fuel tank's vapor space and fuel tank pressure with reduced noise effects from fuel tank temperature fluctuations.

FIG. 1 shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling door 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level 102 ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be an open that is closed upon actuation of the canister vent solenoid.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. As elaborated herein at FIGS. 2-3, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22. As elaborated herein at FIGS. 2-3, a vehicle control system may determine whether to perform a fuel system leak diagnostic routine based on fluctuations in a fuel tank temperature following a vehicle-off event.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Controller 12 may also be configured to intermittently perform leak detection routines on fuel system 18 to confirm that the fuel system is not degraded. Leak detection routines may be performed while the vehicle is in a vehicle-on condition, including an engine-on condition where the engine is the running to propel the vehicle. Alternatively, leak detection routines may be performed while the vehicle is in a vehicle-off condition, including an engine-off condition where the engine is not running to propel the vehicle.

Leak tests performed while the vehicle engine is on may include applying an engine intake vacuum (generated by the running engine) on the fuel system for a duration (e.g., until a target fuel tank vacuum is reached) and then sealing the fuel system to monitor a subsequent change in fuel tank pressure (e.g., a rate of change in the vacuum level, or a final pressure value). Specifically, the canister purge valve may be opened to apply the engine intake vacuum on the fuel tank, and then, once a threshold fuel tank vacuum is reached, the canister purge valve and the canister vent valve may be closed to isolate the fuel tank, and a rate of vacuum bleed-up the atmospheric pressure is monitored. If a rate of bleed-up is higher than a threshold, a leak may be indicated.

Leak tests performed while the vehicle engine is off may include applying an engine-off natural vacuum on the sealed fuel system for a duration (e.g., until a target fuel tank vacuum is reached) and then monitoring a subsequent change in fuel tank pressure (e.g., a rate of change in the vacuum level, or a final pressure value). Specifically, during engine operation, heat may be rejected from the running engine into the fuel tank, causing a rise in fuel tank pressure and temperature. When the engine is turned off, e.g., following a key-off event, the canister vent valve may be closed to isolate the fuel tank. As such, the ideal gas law, defined by the equation:

$$PV=nRT,$$

wherein P is a pressure of a gas, V is a volume of the gas, n is the number of moles of the gas, T is a temperature of the gas, and R is a rate constant, indicates that a change in pressure of a gas is directly correlated with a change in temperature of the gas. Thus, as the fuel tank cools down, a pressure of the fuel tank may correspondingly also drop (generating a fuel tank vacuum).

Since the above mentioned leak test is based on differences between a fuel tank temperature and ambient conditions, and further based on the relationship between fuel tank pressure and temperature, it is highly sensitive to fluctuations in temperature. In particular, there may be a large variability in fuel tank temperature due to, for example, a location where the vehicle is parked (e.g., inside or outside), temperature of the parking surface, exhaust component locations, drive cycle of the vehicle (e.g., city or highway driving), etc. As such, based on a vehicle operator's parking habit and environmental conditions (e.g., wind or sun loading on the vehicle), the temperature sensitive engine-off leak test may result in large alpha or beta errors, making the test prone to indicating false pass or false fail results. As an example, based on the temperature of a parking spot where a vehicle is parked (e.g., based on the vehicle being parked inside or outside, in a covered lot or open lot, parked on hot asphalt, etc.), a larger change in fuel tank pressure can be experienced in the presence of a leak, causing the leak detection routine to indicate a false pass. As another example, a refueling event that fills the gas tank with cool fuel followed by a short drive with the engine on may not reject sufficient heat to the fuel tank. As a result, the fuel bulk mass may not be sufficiently warmed to generate sufficient pressure for a reliable leak test. As a result, a false fail may be indicated during an engine-off EONV leak test. The same may occur in a hybrid vehicle where the engine is not turned on frequently enough, or long enough, to reject sufficient heat to a fuel tank for an EONV leak test. In other words, temperature can be both a control factor as well as a noise factor in such leak detection routines.

The inventors herein have recognized that the same ideal gas law can be used to identify fuel system leaks by using the molar content of the gas ('n' in the ideal gas law equation) as the control factor rather than temperature ('T' in the ideal gas law equation). In particular, a leak detection may be performed after a sufficient duration has elapsed since a vehicle-off event wherein the vehicle has been in a vehicle-off condition with no interim automatic engine operation for the duration. In other words, leak detection may be performed after a vehicle engine has been turned off for a sufficient amount of time that allows a fuel tank temperature to stabilize to ambient conditions. In doing so, the noise contribution of temperature is reduced. During such conditions, the fuel tank 20 may be sealed and a fuel pump 21 may be operated to agitate the fuel and produce vapors. The increase in vapors increases the molar content of fuel in the gas ("n" in the ideal gas law equation) and results in a corresponding rise in fuel tank pressure. After a threshold pressure is reached, or after a threshold moles of fuel vapor have been added to the vapor space 103 of the fuel tank 20, the fuel pump 21 may be turned off and a pressure bleed-down is monitored. Fuel system leaks are then identified based on the bleed-down rate, with the bleed-down being faster than a threshold rate in the presence of a leak. Herein, the threshold rate may be temperature-calibrated for a fuel tank temperature condition. In this way, by performing a leak test based on the relation between molar content "n" of a gas and pressure "P" of the gas, corruption of leak test results due to temperature fluctuations can be reduced and leak test reliability is improved.

Further, by using an active leak test based on the molar fuel content of fuel vapor rather than an opportunistic leak test that is based on the temperature of fuel vapor, the frequency of running and completing a leak test is improved. In particular, regulatory agency stipulated completion targets (e.g., a completion target of 26%) can be better met.

It will be appreciated that vehicle-off conditions (or vehicle-off events) may vary based on the configuration of the vehicle system. For example, embodiments of vehicle-off conditions may vary for hybrid-drive enabled vehicle systems, non-hybrid-drive enabled vehicle systems, and push-button engine start-enabled vehicle systems. It will be appreciated, however, that the vehicle-off conditions referred to herein are one-to-one equivalent to engine-off conditions.

As a first example, in vehicles configured with an active key, a vehicle-off condition may include a key-off condition. As such, in active key-based vehicle configurations, the active key is inserted into a keyhole to move the position of a keyhole slot between a first position corresponding to a vehicle-off condition, a second position corresponding to a vehicle-on condition, and a third position corresponding to a starter-on condition. To start cranking the vehicle engine, the key is inserted in the keyhole and the slot is initially positioned at the first position to start operating the engine starter. Following engine start, the slot is shifted to the second position to signal that the engine is running. A vehicle-off event occurs when the active key is used to shift the slot to the third position, followed by removal of the key from the slot. In response to the slot being shifted to the third position by the active key, an engine-off as well as a vehicle-off condition is indicated.

As a second example, in vehicles configured with start/stop button, a vehicle-off condition may include a stop button actuated condition. In such embodiments, the vehicle may include a key that is inserted into a slot, as well as an additional button that may be alternated between a start position and a stop position. To start cranking the engine, the vehicle key is inserted in the keyhole to move the slot to an "on" position and additionally the start/stop button is pushed (or actuated) to the start position to start operating the engine starter. Herein, a vehicle-off condition is indicated when the start/stop button is actuated to the stop position As a third example, in vehicles configured with a passive key, a vehicle-off condition may include the passive key being outside a threshold distance of the vehicle. The passive key may include an ID tag, such as an RFID tag, or a wireless communication device with a specified encrypted code. In such embodiments, in place of an engine keyhole, the passive key is used to indicate the presence of a vehicle operator in the vehicle. An additional start/stop button may be provided that can be alternated between a start position and a stop position to accordingly start or stop the vehicle engine. To start running the engine, the passive key must be present inside the vehicle, or within a threshold distance of the vehicle) and the button needs to be pushed (actuated) to a start position to start operating the engine starter. A vehicle-off (and also engine-off) condition is indicated by the presence of the passive key outside the vehicle, or outside a threshold distance of the vehicle.

Returning to FIG. 1, vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. As another example, the actuators may include fuel injector 66, isolation valve 110, purge valve 112, vent valve 114, fuel pump 21, and throttle 62. The control system 14 may include a controller 12. The controller may be shifted between sleep and wake-up modes for additional energy efficiency. The controller may receive input data from the various sensors, process the input data, and trigger the actuators in response to the processed input data based on instruction or code programmed therein corresponding to one or more routines. Example control routines are described herein with regard to FIGS. 2-3.

In this way, the system of FIG. 1 enables a method for identifying leaks in a fuel system comprising during a vehicle-off condition, and while a fuel tank temperature stays within a threshold range, operating a fuel pump to raise a fuel tank vapor pressure to identify leaks in the fuel system.

Figure 2:
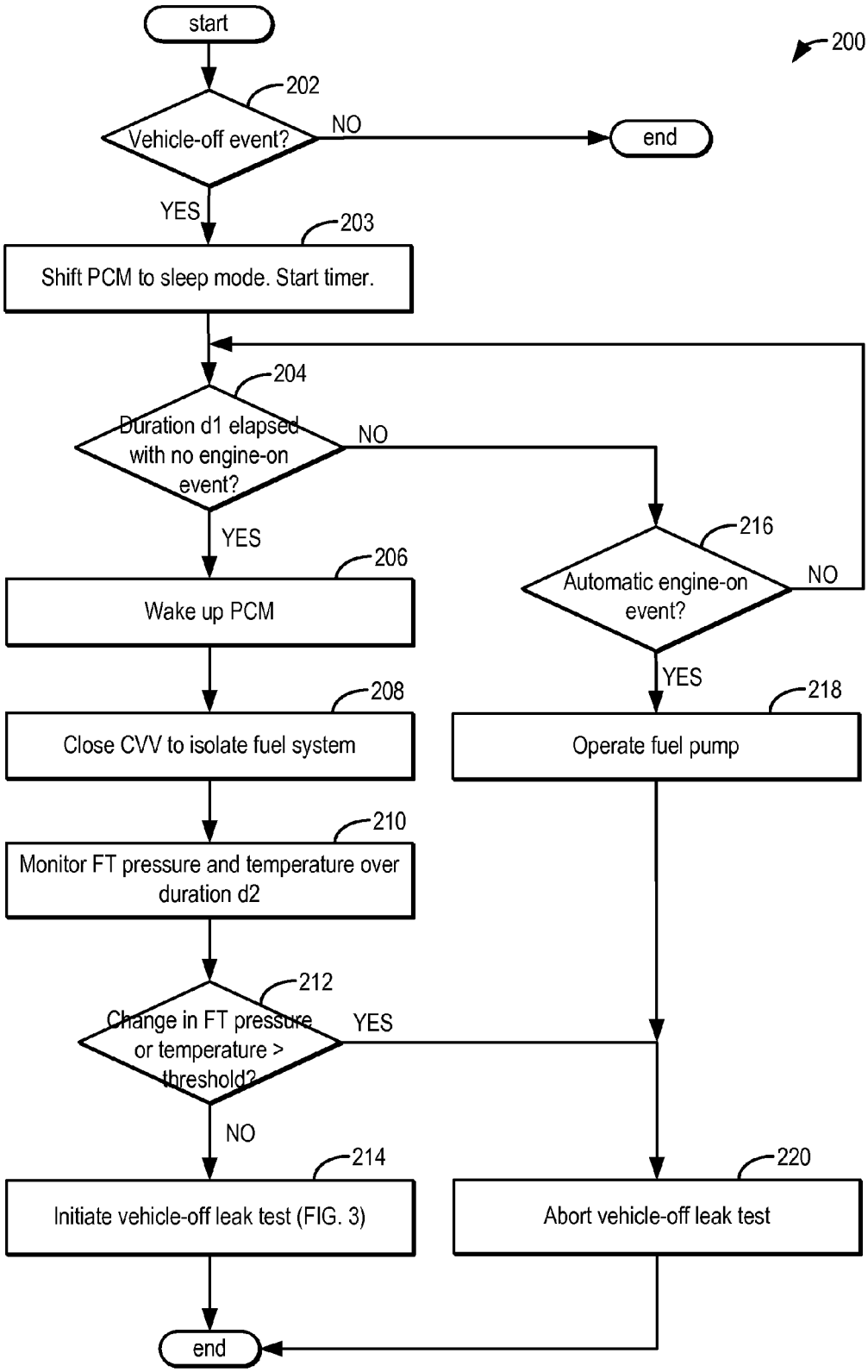
FIG. 2 shows a high level flow chart illustrating a routine that may be implemented for determining whether to initiate a vehicle-off leak test.

Now turning to FIG. 2, an example routine 200 is shown for determining whether to operate a fuel pump and identify fuel system leaks based on a fuel tank pressure during vehicle-off conditions. By performing the leak test when fuel tank temperatures are stabilized, temperature-induced noise is reduced and leak diagnostics accuracy is increased.

At 202, the routine includes confirming a vehicle-off event. A vehicle-off event may be confirmed in response to a key-off condition where the vehicle includes an active key, a stop button actuated condition where the vehicle includes an ignition start/stop button, and a passive key being outside a threshold distance of the vehicle where the vehicle includes a passive key. In response to the vehicle-off event, at 203, a controller of the vehicle system (such as a vehicle powertrain control module or PCM) may be shifted to a sleep mode to reduce vehicle-off energy consumption by on-board sensors, auxiliary components, and diagnostics. In addition, a timer may be started.

Upon confirming a vehicle-off event, at 204, it may be determined if a first duration d1 has elapsed since the vehicle-off event with no intermediate automatic engine-on event. For example, it may be determined if duration d1 has elapsed on the timer that was started at 203. The first duration may be a first longer duration, such as a few hours since the vehicle-off event. As such, if the vehicle remains in the vehicle-off condition for the first duration since the vehicle-off event, a fuel tank temperature is expected to stabilize to ambient conditions, and therefore a fuel tank pressure is also expected to be stable. Stabilization of fuel tank temperature and pressure conditions reduces an amount of noise encountered during a subsequent leak test routine, improving accuracy and reliability of leak test results.

In particular, at 204, it may be determined that the vehicle has been in the vehicle-off condition for the first duration with no intermediate automatic engine-on event during the vehicle-off condition. Herein, the automatic engine-on event includes events wherein the engine is turned on automatically, and without input from a vehicle operator. As an example, in vehicle's configured with idle start/stop systems, the automatic engine-on event may include an automatic engine restart from idle-stop in response to engine operating parameters falling outside a threshold range. For example, the engine may be automatically started by the vehicle controller in response to a battery state of charge falling below a threshold or in response to an air pressure in a compressor falling below a threshold. Accordingly, if the vehicle has not been in the vehicle-off condition for the first duration with no intermediate automatic engine-on event, at 216, it may be determined if an automatic engine-on event has occurred during the vehicle-off condition. If yes, then at 218, in response to the automatic engine-on event, a fuel pump may be operated and at 220, identifying of leaks in the fuel system via a vehicle-off leak test may be aborted. A fuel system vehicle off leak test may be reattempted during a subsequent vehicle-off event.

Returning to 204, upon confirmation that conditions for vehicle-off fuel tank pressure and temperature stabilization are met, at 206, the routine includes waking up the vehicle system controller from the sleep mode upon elapse of the first duration. Specifically, the controller may be shifted from the sleep mode to a wake-up mode. At 208, after waking up the controller, the fuel system may be isolated or sealed. In particular, the fuel system may include a fuel tank coupled to a canister, the canister coupled to an engine intake via a canister purge valve and further coupled to atmosphere via a canister vent valve, wherein sealing the fuel system includes closing each of the canister vent valve and canister purge valve. In one example, a canister vent solenoid may be actuated so as to close the canister vent valve. Likewise, a canister purge solenoid may be actuated so as to close the canister purge valve.

Next, at 210, after sealing the fuel system, routine includes monitoring the fuel tank temperature for a second duration (d2) since the waking up. As such, the first duration is longer than the second duration. For example, the second duration may be in minutes or seconds while the first duration is in hours.

At 212, it may be determined if there was a change in fuel tank temperature, or pressure, over the second duration, and further if the change was more than a threshold. In particular, a fuel tank temperature and pressure may be monitored for variations and fluctuations arising from environmental conditions. As such, the monitoring may be performed after a sufficient duration has elapsed since the vehicle-off event occurred, wherein it may be assumed that the fuel tank temperatures and pressures are stable. However, there may be local and temporary temperature and pressure variations due to changes in ambient conditions at the location where the vehicle is parked. For example, if the vehicle is parked in an outdoor lot (with no covering), there may be a fuel tank temperature and pressure fluctuation due to warm ambient conditions at a time when the controller is woken up to do the monitoring.

If the change in fuel tank temperature and pressure is not more than the threshold (e.g., the temperature is within a threshold range), then at 214 it may be determined that leak test entry conditions have been met and that an engine-off leak test can be initiated. As elaborated at FIG. 3, the engine-off leak test may then be performed by operating a fuel pump to raise a fuel tank vapor pressure and then indicating a fuel system leak based on a subsequent rate of pressure bleed-down.

If the change in fuel tank temperature and pressure is higher than the threshold (that is, outside the threshold range), then at 216 it may be determined that leak test entry conditions have not been met and that a vehicle-off leak test cannot be initiated. In particular, a leak test attempt on the current vehicle-off cycle may be aborted and a leak test may be retried at a subsequent vehicle-off event. Alternatively, the controller may be shifted to a snooze mode and the timer may be reset to zero, so that the controller can be woken up again after a threshold duration has elapsed. After waking up, the controller may resume monitoring of a fuel tank temperature and pressure and if there is no substantial change (e.g., the change is not more than the threshold), a leak test may be initiated.

In this way, during a vehicle-off condition, and while a fuel tank temperature stays within a threshold range, a fuel pump is operated to raise a fuel tank vapor pressure to identify leaks in the fuel system. A fuel system leak is then indicated based on a change in fuel tank pressure after a duration of operating the fuel pump and while the fuel tank temperature stays within the range. In comparison, in response to the fuel tank temperature going outside the threshold range, the fuel pump is not operated and leaks in the fuel system are not identified.

Figure 3:
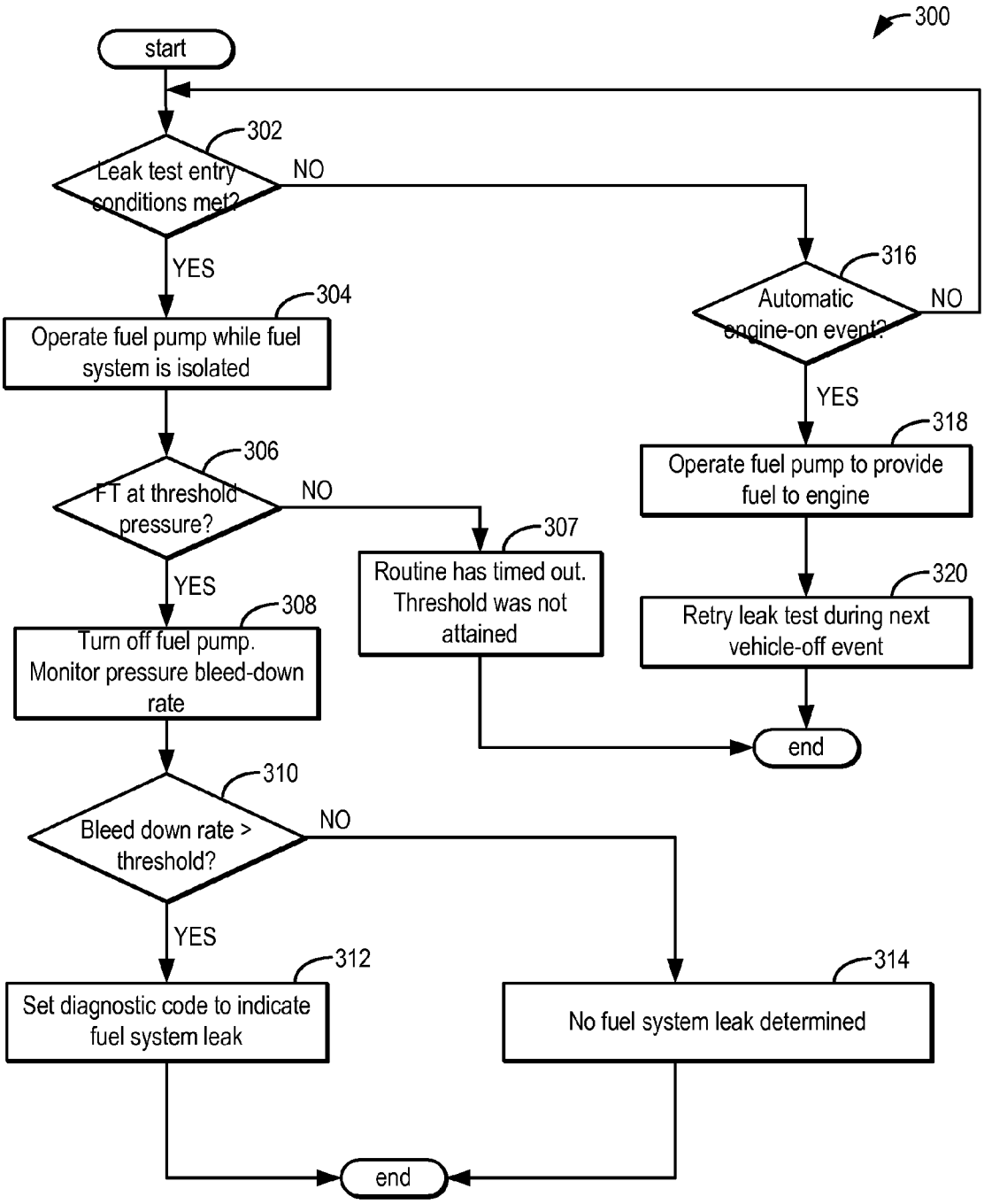
FIG. 3 shows a high level flow chart illustrating a routine that may be implemented for operating a fuel pump to perform a vehicle-off leak test.

Now turning to FIG. 3, routine 300 shows an example vehicle-off (and engine-off) leak test that may be performed during a vehicle-off condition by operating a fuel pump. Herein, a leak is identified based on correlations between fuel tank pressure and molar content of a gas in the vapor space of a fuel tank, while a fuel tank temperature holds constant, as described by the ideal gas law equation (PV=nRT).

At 302, it may be confirmed that leak test entry conditions have been met. As elaborated at FIG. 2, this includes confirming that a vehicle-off event has occurred, that the vehicle has remained in the vehicle-off condition for a first, longer duration (e.g., in hours) with no automatic engine-on event occurring, and that after the first duration, when a fuel tank temperature and pressure is monitored for a second shorter duration (e.g., in minutes or seconds), there has been no substantial fluctuation in temperature or pressure (e.g., the fuel tank temperature has remained within a threshold range).

If leak test entry conditions are not met, then at 316 it may be determined if an automatic engine-on event has occurred. For example, it may be determined if an automatic engine-on event has occurred while the vehicle was in the vehicle-off condition for the first and/or second duration. As such, during the vehicle-off condition, a vehicle engine may have been turned off by the vehicle operator and the engine may not be running. However, a vehicle engine may be turned on automatically, and without input from the vehicle operator, in response to selected conditions. As an example, a vehicle engine may be automatically turned on in response to a battery state of charge being lower than a threshold (e.g., less than 30%) so as to charge the battery. If the vehicle engine is automatically turned on by a vehicle controller, then at 318, a fuel pump coupled to the fuel tank may be operated to provide fuel to fuel injectors coupled to engine cylinders. In addition, at 320, a vehicle-off leak test may be aborted on the current vehicle-off cycle and a leak test may be retried during a subsequent vehicle-off event.

If leak test entry conditions are met, at 304, the routine includes operating the fuel pump while the fuel tank is isolated. In one example, operating the fuel pump may include operating the fuel pump at 100% duty cycle. However, in alternate examples, in order to save battery power and reduce NVH issues, the fuel pump may be operated below 100% duty cycle, for example, at 50% duty cycle or less. As elaborated previously at FIG. 2, the fuel tank may be isolated by closing a canister vent valve (and a canister purge valve). By operating the fuel pump when the fuel tank is sealed, a fuel in the fuel tank may be agitated to produce fuel vapors. As a result, some of the liquid fuel in the fuel tank may shift to a vapor phase, and a molar content of fuel in the vapor space of the fuel tank may increase. This causes a corresponding increase in fuel tank pressure.

In one example, operating the fuel pump includes operating the fuel pump for a duration to raise a vapor pressure of fuel in a vapor space of the fuel tank above a threshold pressure. Alternatively, the fuel pump may be operated for a duration to increase a molar content of the fuel in the vapor space of the fuel tank by a threshold amount. Herein, the threshold increase in molar content (and therefore the duration of fuel pump operation as well as the resulting increase in fuel vapor pressure) may be based on a fill level of the fuel tank. For example, as the fill level of the fuel tank increases, a larger amount of time may be required to agitate the fuel. That is, a duration of fuel agitation and an amount of fuel agitated and transitioned to a vapor phase may be increased. Alternatively, the threshold pressure may be based on the fuel vapor pressure.

It will be appreciated that in alternate embodiments, the threshold pressure up to which the fuel vapor pressure is raised by operating the fuel pump may be kept the same for all active leak tests so as to improve the signal to noise ratio of the tests.

In an alternate example, since the fuel tank pressure is also related to the amount of fuel in the vapor space of the fuel tank, operating the fuel pump may include operating the fuel pump for a duration to raise the fuel tank pressure to a threshold pressure. Here too, the threshold pressure, and therefore the duration of fuel pump operating may be based on a fill level of the fuel tank with the threshold pressure increased as the fill level increases.

At 306, it may be confirmed that the fuel tank pressure is at the threshold pressure. If not, the routine proceeds to 307 to indicate that the threshold was not attained. In particular, the routine may time out if after the duration of fuel pump operation; the threshold pressure is not attained. In still further embodiments, at 307, the routine may indicate that a fuel system leak is present or that the fuel pump is not working properly in response to the threshold pressure not being attained upon operating the fuel pump. By timing the routine if the threshold pressure is not attained, battery charge may be conserved.

Upon confirming that the threshold fuel tank pressure has been attained, at 308, the fuel pump may be turned off. After discontinuing fuel pump operation, a change in fuel tank pressure after the duration of pump operation may be monitored, and fuel system leaks may be diagnosed based on a rate of change in fuel tank pressure relative to a threshold rate. In other words, a bleed-down of the fuel tank pressure may be monitored and compared to a threshold rate. The threshold rate may be calibrated based on the fuel tank temperature. For example, as the fuel tank temperature increases, the threshold rate may be increased. In still other embodiments, the threshold rate may be calibrated to compensate for one or more of fuel level, altitude (or BP), and fuel type (e.g., based on an alcohol content of the fuel).

At 310, it may be determined if the fuel tank pressure bleed-down rate is higher than the threshold rate. If yes, then at 312, a fuel system leak may be indicated, for example, by setting a diagnostic code. Else, if the fuel tank pressure bleeds down slower than the threshold rate, then at 314, no fuel system leak may be indicated.

In some embodiments, if a leak is confirmed, the routine may further proceed to close the fuel tank isolation valve (between the fuel tank and the canister) and re-run the leak test. This allows the fuel system to be isolated to the tank side during a first leak test and to a canister side during a second, different leak test. A leak may then be confirmed based on the results of both leak tests.

In this way, fuel system leaks may be identified only during conditions when fuel tank temperatures are stable. By operating a fuel pump to agitate fuel from a liquid phase into a vapor phase, a molar content of fuel in the vapor space of a fuel tank can be intentionally increased to raise a fuel tank pressure. By identifying a fuel system leak based on a subsequent rate of pressure decay, incorrect fuel system leak diagnostics resulting from fluctuations in fuel tank temperature can be reduced.

In one example, a hybrid vehicle system includes an engine having an intake. The vehicle system includes a fuel system including a fuel tank, a canister, a first valve coupling the canister to the engine intake, a second valve coupling the canister to atmosphere, and a fuel pump coupled to the fuel tank. A pressure sensor and a temperature sensor are coupled to the fuel tank for estimating a fuel tank pressure and temperature, respectively. The vehicle system further includes a control system with computer readable instructions for waking up the control system from a sleep mode following a duration since a vehicle-off event. The control system then monitors a fuel tank pressure after the waking up. If the fuel tank pressure stays within a threshold range during the monitoring, the control system closes the first and second valves to seal the fuel tank, and operates the fuel pump to raise a fuel tank pressure. Fuel pump operation is discontinued when the fuel tank pressure is at a threshold pressure, and fuel system leaks are indicated based on a rate of pressure bleed-down from the threshold pressure. In particular, a fuel system leak is indicated based on the rate of pressure bleed-down from the threshold pressure being faster than a threshold rate, where one or more of the threshold pressure and the threshold rate is calibrated based on a fuel tank temperature. For example, as the fuel tank temperature increases, the threshold rate may be increased.

The control system includes further instructions for not operating the fuel pump and not indicating fuel system leaks in response to the fuel tank pressure not staying within the threshold range during the monitoring or the engine being turned on automatically, and without input from a vehicle operator, during the monitoring.

Figure 4:
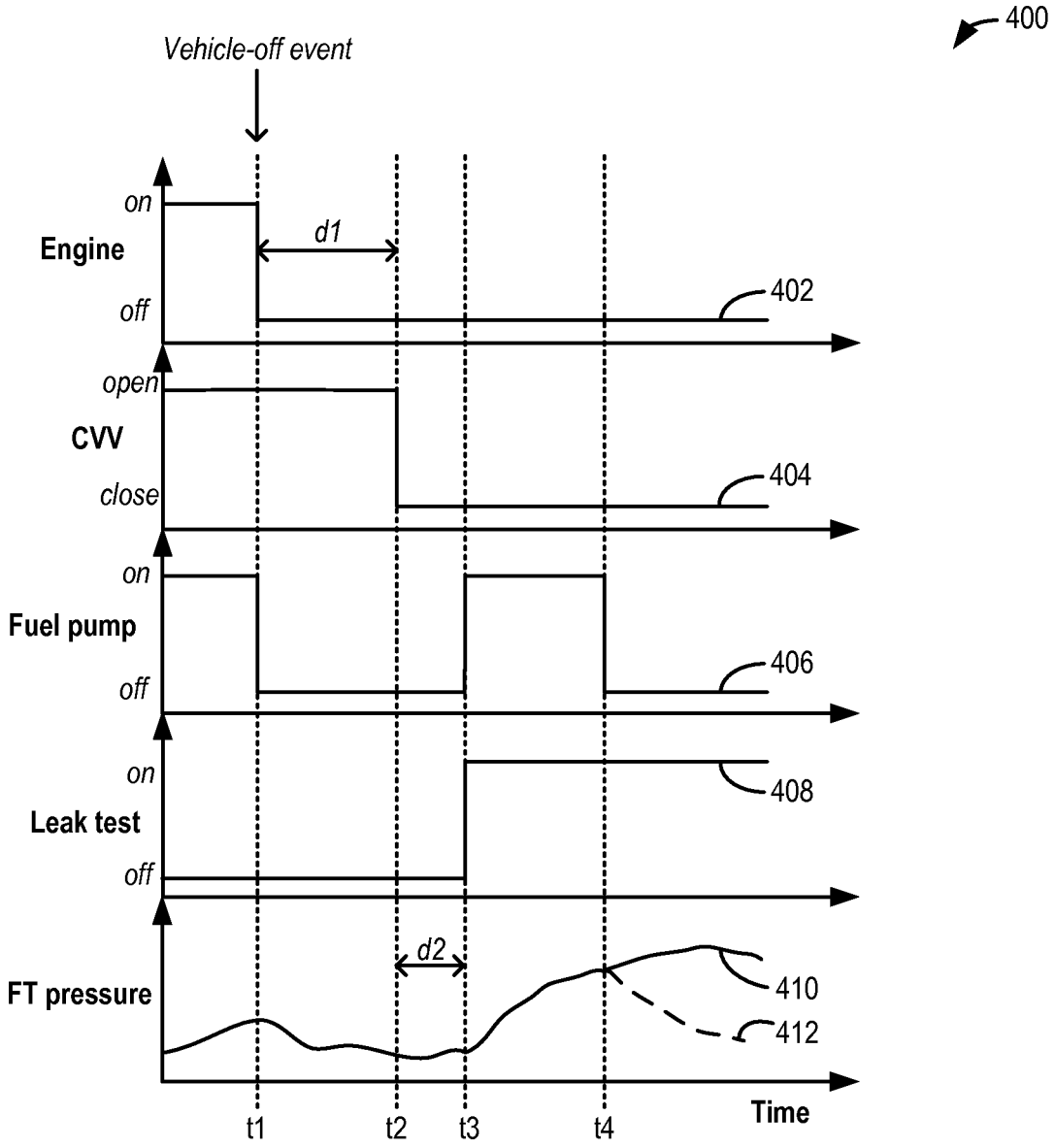
FIGS. 4-6 show example vehicle-off leak tests.
Figure 5:
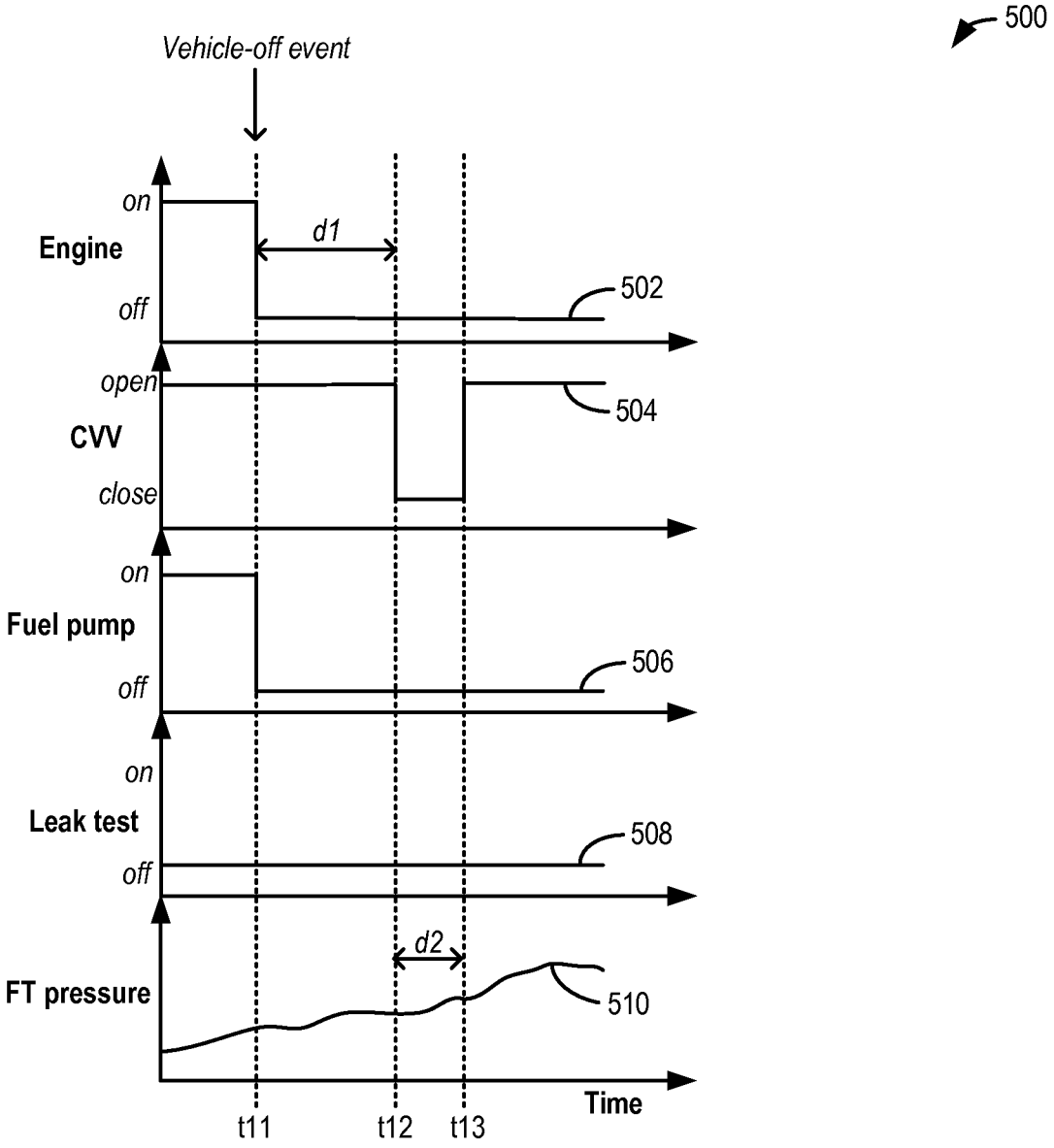
Figure 6:
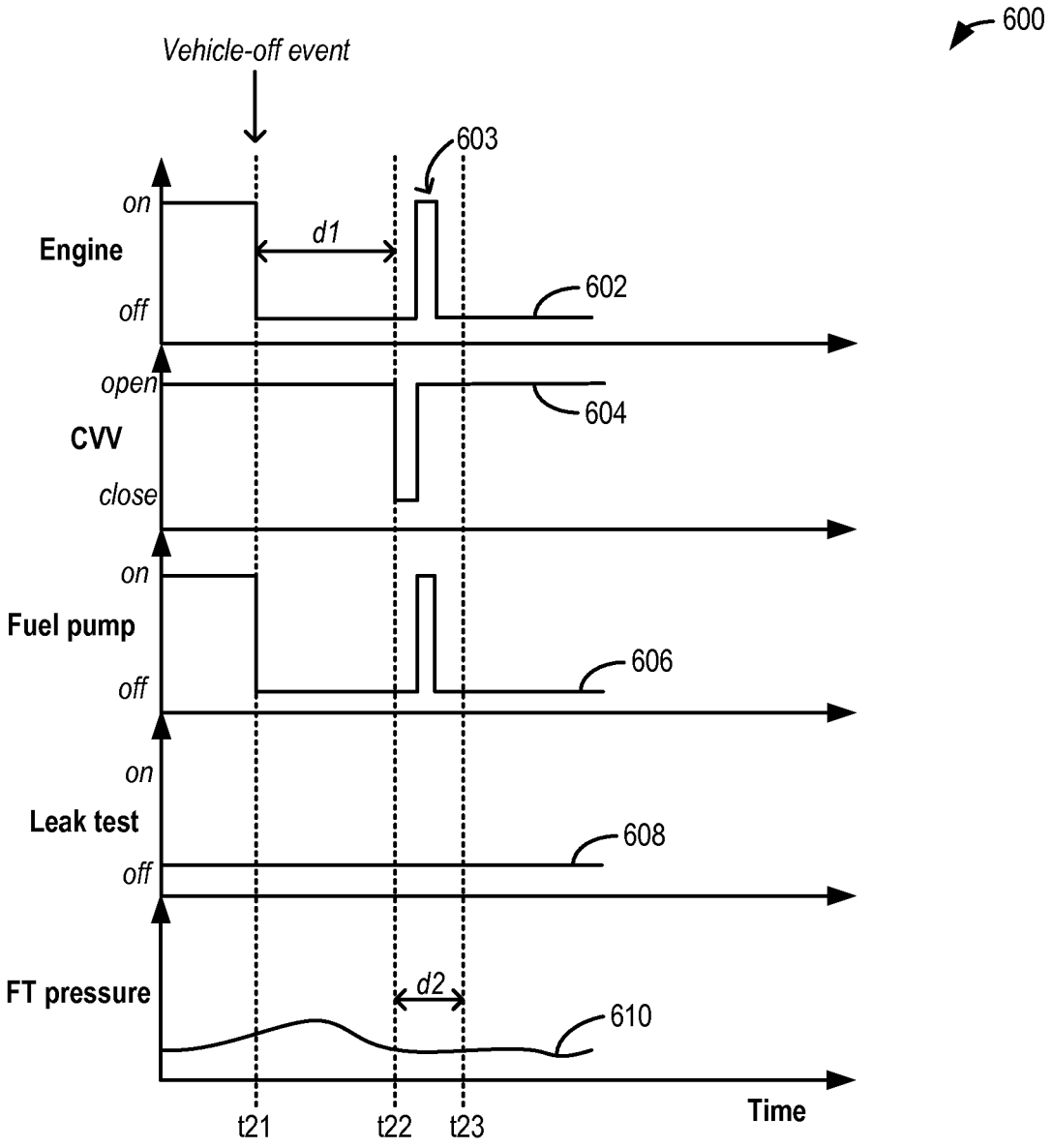

Example leak tests are now elaborated at FIGS. 4-6. Turning first to FIG. 4, an example vehicle-off leak test is shown at map 400. Specifically, an indication of whether an engine is on or off is provided at plot 402, the status (open or closed) of a canister vent valve is indicated at plot 404, fuel pump operation (on or off) is shown at plot 406, status of a vehicle-off leak test (on or off) is shown at plot 408, and changes in fuel tank (FT) pressure based on operation of the fuel pump are shown at plot 410. All graphs are plotted over time along the x-axis.

Prior to t1, the vehicle may be operating with the engine running (plot 402). Accordingly, a fuel pump may be operating (that is, the fuel pump is on) to provide fuel to engine cylinder fuel injectors (plot 406). No leak test may be performed at this time (plot 408) and a canister vent valve may be left open (plot 404) so that diurnal or "running loss" vapors generated during engine running can be adsorbed in a fuel system canister. While the engine is running, heat may be rejected from the running engine to the fuel tank, causing a rise in fuel tank temperature and a corresponding rise in fuel tank pressure (plot 410).

At t1, a vehicle-off event is confirmed. For example, at t1, an operator may indicate a desire to turn off the vehicle engine by performing a key-off wherein an active key of the vehicle is shifted to an off position and pulled out of a keyhole slot. In response to the vehicle-off event, a vehicle controller (e.g., a control module) may be shifted to a sleep mode and the fuel pump may be switched off (plot 406). Due to the engine being turned off, heat rejection to the fuel tank may stop, and a fuel tank temperature may gradually reduce and stabilize to ambient conditions. Consequently, a corresponding drop and stabilization in fuel tank pressure may also be observed (plot 410).

At t2, upon the elapse of a first (longer) duration d1 (e.g., a couple of hours) since the vehicle-off event, the vehicle controller may be woken up (e.g., shifted from the sleep mode to an awake mode). Upon waking up, the controller may seal the fuel system by closing the canister vent valve (plot 404). For example, the canister vent valve may be closed by actuating a canister vent solenoid. The controller may then monitor a change in fuel tank temperature for a second, shorter duration d2 (e.g., a couple of minutes), between t2 and t3. In the present example, in response to no substantial change in fuel tank temperature over second duration d2 (that is, based the fuel tank temperature remaining within a threshold range between t2 and t3), it may be determined that fuel tank temperatures are stable and that leak test accuracy is not likely to be degraded due to fluctuations in fuel tank temperature.

Accordingly, at t3, a leak test may be initiated (plot 408). Therein, with the fuel tank sealed (plot 404), the fuel pump may be actuated on to raise a fuel tank vapor pressure. In particular, the agitation of fuel in the fuel tank due to the operation of the fuel pump generates vapors which increase the molar fuel content in the vapor space of the fuel tank. The rise in fuel vapor pressure results in a corresponding rise in fuel tank pressure (plot 410).

Fuel pump operation may be continued from t3 until t4. At t4, in response to a threshold fuel tank pressure being attained, the fuel pump may be switched off. Then, with the fuel system still sealed, a rate of bleed-down of fuel tank pressure from the threshold pressure may be monitored. An expected rate of pressure bleed-down may be determined based on the (current) fuel tank temperature. If the rate of pressure bleed-down is at or below the expected rate, as shown by plot 410 (solid line), no fuel system leak may be determined. However, if the rate of pressure bleed-down is higher than the expected rate, as shown by plot 412 (dashed line), a fuel system leak may be determined and indicated by setting an appropriate diagnostic code.

Another example vehicle-off leak test operation is shown at map 500 of FIG. 5. Specifically, an indication of whether an engine is on or off is provided at plot 502, the status (open or closed) of a canister vent valve is indicated at plot 504, fuel pump operation (on or off) is shown at plot 506, status of a vehicle-off leak test (on or off) is shown at plot 508, and changes in fuel tank (FT) pressure based on operation of the fuel pump are shown at plot 510. All graphs are plotted over time along the x-axis.

Here, as with the example of FIG. 4, prior to t11, the vehicle may be operating with the engine running (plot 502), as well as the fuel pump operating to provide fuel to engine cylinder fuel injectors (plot 506). No leak test may be performed at this time (plot 508) and a canister vent valve may be left open (plot 504) so that diurnal or "running loss" vapors generated during engine running can be adsorbed in a fuel system canister. Heat rejected from the running engine to the fuel tank prior to t11 may cause a rise in fuel tank temperature and consequently, a rise in fuel tank pressure (plot 510).

At t11, a vehicle-off event is confirmed. In response to the vehicle-off event, a vehicle controller may be shifted to a sleep mode and the fuel pump may be switched off (plot 506). Due to the engine being turned off, heat rejection to the fuel tank may stop, and a fuel tank temperature is expected to gradually stabilize to ambient conditions, with a corresponding drop and stabilization in fuel tank pressure (plot 510). However, in the present example, due to a location where the vehicle is parked by the operator, as well as environmental conditions of the parking area, a temperature of the parking surface may be elevated, causing a gradual rise in fuel tank temperature and pressure.

At t12, upon the elapse of first duration d1 since the vehicle-off event, the vehicle controller is woken up and the fuel system is sealed by closing the canister vent valve (plot 504). The controller then monitors a change in fuel tank temperature for a second duration d2, between t12 and t13. In the present example, a fuel tank temperature and pressure may continue to rise while the vehicle is parked. This may be due to a location where the vehicle is parked by the operator, as well as environmental conditions of the parking area. In response to a substantial change in fuel tank temperature over second duration d2 (that is, based on the fuel tank temperature going outside a threshold range between t12 and t13), it may be determined that fuel tank temperatures are not stable and that corruption of leak test results may occur due to the fluctuations in fuel tank temperature. Accordingly, at t13, no vehicle-off leak test is performed (plot 508). In particular, a leak test is aborted for the given vehicle-off cycle and may be retried at a subsequent vehicle-off event.

Yet another example vehicle-off leak test operation is shown at map 600 of FIG. 6. Specifically, an indication of whether an engine is on or off is provided at plot 602, the status (open or closed) of a canister vent valve is indicated at plot 604, fuel pump operation (on or off) is shown at plot 606, status of a vehicle-off leak test (on or off) is shown at plot 608, and changes in fuel tank (FT) pressure based on operation of the fuel pump are shown at plot 610. All graphs are plotted over time along the x-axis.

Here, as with the example of FIGS. 4-5, prior to t21, the vehicle may be operating with the engine running (plot 602), as well as the fuel pump operating to provide fuel to engine cylinder fuel injectors (plot 606). No leak test may be performed at this time (plot 608) and a canister vent valve may be left open (plot 604) so that diurnal or "running loss" vapors generated during engine running can be adsorbed in a fuel system canister. Heat rejected from the running engine to the fuel tank prior to t21 may cause a rise in fuel tank temperature and consequently, a rise in fuel tank pressure (plot 610).

At t21, a vehicle-off event is confirmed. In response to the vehicle-off event, a vehicle controller may be shifted to a sleep mode and the fuel pump may be switched off (plot 606). Due to the engine being turned off, heat rejection to the fuel tank may stop, and a fuel tank temperature gradually stabilizes to ambient conditions, with a corresponding drop and stabilization in fuel tank pressure.

At t22, upon the elapse of first duration d1 since the vehicle-off event, the vehicle controller is woken up and the fuel system is sealed by closing the canister vent valve (plot 604). The controller then monitors a change in fuel tank temperature for a second duration d2, between t22 and t23. In the present example, a fuel tank temperature and pressure remains stable for the second duration. At the same time, a battery status of a vehicle system battery (that may be the same as or different from a battery coupled to the fuel pump motor) may be monitored by a vehicle controller (not shown). Between t22 and t23, a low battery state of charge may be noted by the controller. In response to the low battery state of charge, a vehicle controller may turn on the engine. For example, where the vehicle is configured to be selectively deactivated in response to idle-stop conditions being met and automatically restart in response to restat conditions being metan automatic engine-on event may occur between t22 and t23 (plot 602). In particular, as shown at 603, the engine may be turned on automatically, and without input from a vehicle operator. For example, the engine may be automatically turned on in response to a drop in a system battery state of charge below a threshold level. In response to the engine being automatically turned on, the fuel pump may also be turned on to provide fuel for running the engine (plot 606). In addition, in response to the battery state of charge being low, the leak test may be aborted (plot 608).

In an alternate embodiment, the engine may be turned on due to an alternate restart condition being met (e.g., due to a compressor air pressure being lower than a threshold), Therein, in response to the automatic engine-on event occurring while a fuel tank temperature was being monitored, it may be determined that fuel tank temperatures may not remain stable and that corruption of leak test results may consequently occur due to fluctuations in fuel tank temperature (e.g., due to heat rejection from the running engine to the fuel tank). Accordingly, at t23, no vehicle-off leak test is performed (plot 608). In particular, a leak test is aborted for the given vehicle-off cycle and may be retried at a subsequent vehicle-off event.

In this way, by operating a fuel pump to raise an amount of fuel vapor in a fuel tank, and consequently a fuel tank pressure, molar content rather than temperature may be used as a control factor for detecting fuel system leaks based on ideal gas law principles. By performing a vehicle-off leak test only during conditions when a fuel tank temperature and pressure are stable, discrepancies in leak test results arising from temperature fluctuations can be reduced. By relying on the correlation between moles of a gas and pressure of a gas, an active engine-off leak test can be run regardless of whether heat was generated at an engine or whether sufficient heat was rejected to a fuel tank or not. By using an active leak test based on the molar fuel content of fuel vapor rather than an opportunistic leak test that is based on the temperature of fuel vapor, the frequency of running and completing a leak test is improved. This improves leak detection in hybrid vehicles where engine run times are low. By also removing a temperature noise factor from the leak diagnostic, a reliability of the leak diagnostics is improved. In addition, since an existing fuel pump is used to pressurize the fuel system for a leak test, component reduction benefits are achieved. By improving leak detection, exhaust emissions can be improved.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A method for a vehicle fuel system, comprising:

during a vehicle-off condition, and while a fuel tank temperature stays within a threshold range, operating a fuel pump to raise a fuel tank vapor pressure to identify leaks in the fuel system, a duration of operating the pump based on a fill level of fuel in a fuel tank.

2. The method of claim 1, wherein operating the fuel pump to raise the fuel tank vapor pressure includes operating the fuel pump for the duration to raise the vapor pressure above a threshold pressure.

3. The method of claim 2, wherein the duration of operating the fuel pump, based on the fill level of fuel in the fuel tank includes increasing the duration of operating the fuel pump as the fill level of fuel in the fuel tank increases.

4. The method of claim 2, further comprising, indicating a fuel system leak based on a change in fuel tank vapor pressure after the duration and while the fuel tank temperature stays within the threshold range.

5. The method of claim 4, wherein the indicating includes indicating the fuel system leak in response to the change in fuel tank pressure after the duration being above a threshold, the threshold adjusted based on the fuel tank temperature.

6. The method of claim 5, wherein a vehicle controller is set to a sleep mode in response to an onset of the vehicle-off condition, and wherein operating the fuel pump during the vehicle-off condition further includes waking up the vehicle controller from the sleep mode upon elapse of a first duration since the onset of the vehicle-off condition, sealing the fuel tank, and monitoring the fuel tank temperature for a second duration since the waking up, the first duration longer than the second duration.

7. The method of claim 6, further comprising, in response to the fuel tank temperature going outside the threshold range, not operating the fuel pump to identify leaks in the fuel system.

8. The method of claim 7, further comprising, in response to an automatic engine-on event during the vehicle-off condition, operating the fuel pump and aborting the identifying of leaks in the fuel system.

9. The method of claim 8, wherein the automatic engine-on event includes an engine being turned on automatically, and without input from a vehicle operator.

10. The method of claim 9, wherein the automatic engine-on event includes an automatic engine restart from idle-stop.

11. The method of claim 1, wherein the vehicle-off condition includes a key-off condition where a vehicle includes an active key, a stop button actuated condition where the vehicle includes an ignition start/stop button, and a passive key being outside a threshold distance of the vehicle where the vehicle includes the passive key.

12. A method for a vehicle fuel system, comprising:

monitoring a fuel tank pressure after a vehicle-off event; and in response to a change in fuel tank pressure during the monitoring being less than a threshold, sealing the fuel system by closing a canister vent valve and operating a fuel pump to raise fuel tank pressure to a threshold pressure; and indicating fuel system leaks based on a rate of bleed-down from the threshold pressure.

13. The method of claim 12, wherein the indicating includes indicating the fuel system leak based on the rate of bleed-down from the threshold pressure being faster than a threshold rate, the threshold rate based on one or more of a fuel tank temperature, a fuel level in a fuel tank, altitude, and fuel type.

14. The method of claim 13, wherein the fuel system includes a fuel tank coupled to a canister, the canister coupled to an engine intake via a canister purge valve and further coupled to atmosphere via the canister vent valve, and wherein sealing the fuel system further includes closing the canister purge valve.

15. The method of claim 14, wherein the threshold pressure is based on one or more of a vapor pressure of fuel vapors in a vapor space of the fuel tank and a fill level of the fuel tank.

16. The method of claim 15, wherein the vehicle fuel system includes a controller that is shifted to a sleep mode in response to the vehicle-off event, and wherein monitoring the fuel tank pressure after the vehicle-off event includes, waking up the controller from the sleep mode after a first duration since the vehicle-off event and monitoring the fuel tank pressure for a second duration after the waking, the second duration being shorter than the first duration.

17. The method of claim 16, further comprising, in response to the change in fuel tank pressure being more than the threshold, re-monitoring the fuel tank pressure for the second duration, and in response to the change in fuel tank pressure during the re-monitoring being less than the threshold, sealing the fuel system and operating the fuel pump to identify fuel system leaks.

18. A vehicle system, comprising:

an engine including an intake;

a fuel system including a fuel tank, a canister, a first valve coupling the canister to the engine intake, a second valve coupling the canister to atmosphere, and a fuel pump coupled to the fuel tank;

a pressure sensor coupled to the fuel tank for estimating a fuel tank pressure; and a control system with computer readable instructions for:

waking up from a sleep mode following a duration since a vehicle-off event;

monitoring the fuel tank pressure after the waking up; and if the fuel tank pressure stays within a threshold range during the monitoring, closing the first and second valves to seal the fuel tank;

operating the fuel pump for a duration based on a fuel tank fill level to raise the fuel tank pressure;

discontinuing fuel pump operation when fuel tank pressure is at a threshold pressure; and indicating fuel system leaks based on a rate of pressure bleed-down from the threshold pressure.

19. The system of claim 18, wherein the control system includes further instructions for not operating the fuel pump and not indicating fuel system leaks in response to the fuel tank pressure not staying within the threshold range during the monitoring and the engine being turned on automatically, and without input from a vehicle operator, during the monitoring.

20. The system of claim 18, wherein the indicating includes indicating a fuel system leak based on the rate of pressure bleed-down from the threshold pressure being faster than a threshold rate, one or more of the threshold pressure and the threshold rate being based on a fuel tank temperature.

* * * * *